US006341558B1

(12) United States Patent
Hanke et al.

(10) Patent No.: US 6,341,558 B1
(45) Date of Patent: Jan. 29, 2002

(54) DEVICE FOR THE SELECTIVE CLEANING OF SEVERAL CYLINDERS

(75) Inventors: Bernd Hanke, Dresden; Gunnar Tschacher, Radebeul, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/634,595

(22) Filed: Aug. 8, 2000

(30) Foreign Application Priority Data

Aug. 13, 1999 (DE) ..... 199 38 412
Aug. 13, 1999 (DE) ..... 199 38 411

(51) Int. Cl.[7] ..... B41F 35/00
(52) U.S. Cl. ..... 101/425
(58) Field of Search ..... 101/425, 424, 101/423, 483; 15/256.52, 256.51; 134/153, 157

(56) References Cited

U.S. PATENT DOCUMENTS 4,397,235 A * 8/1983 Fischer ..... 101/425
4,981,078 A * 1/1991 Braun ..... 101/425
5,440,986 A * 8/1995 Braun ..... 101/425
5,463,950 A * 11/1995 Cuir et al. ..... 101/425
5,623,876 A * 4/1997 Murphy et al. ..... 101/425

FOREIGN PATENT DOCUMENTS

DE 4209642 A1 3/1992
DE 19512421 C2 4/1995

* cited by examiner

*Primary Examiner*—John S. Hilten
*Assistant Examiner*—Anthony H. Nguyen
(74) *Attorney, Agent, or Firm*—Jones, Tullar & Cooper, PC

(57) ABSTRACT

The invention relates to a device for the selective cleaning of several cylinders of the print unit of a sheet-fed printing press, which is preferably designed in a three-cylinder construction, consisting of a cleaning device which can be selectively placed against each one of the cylinders by being displaced along a guide track. It is the object of the invention to create a device which permits the cleaning of three cylinders with one cleaning arrangement, which can be produced by simple means and permits access to the cylinders. In accordance with the invention, this object is attained in that the cleaning device (27) is displaceable along a guide track (5) designed as a straight guide (6) and is embodied as a functional unit, pivotable around an axis of rotation (34).

11 Claims, 8 Drawing Sheets

DEVICE FOR THE SELECTIVE CLEANING OF SEVERAL CYLINDERS

FIELD OF THE INVENTION

The invention relates to a device for the selective cleaning of several cylinders of the print unit of a sheet-fed printing press, which is preferably designed in a three-cylinder construction, consisting of a cleaning device which can be selectively placed against each one of the cylinders by being displaced along a guide track.

BACKGROUND OF THE INVENTION

Such a device is known from DE 195 12 241 C2. The cleaning device is displaced on both sides in guide tracks, which extend equidistant or nearly equidistant in the sections allocated to the cylinder surfaces, and in this way it approaches the surfaces to be cleaned. A toothed arrangement, which follows the course of the guide tracks, is allocated to the latter, and drive wheels seated in the cleaning device engage the toothed arrangement. The drive wheels are driven by means of a drive mechanism allocated to the cleaning device, and the latter is allocated in this way to the cylinder which is respectively to be cleaned.

The production effort required for producing it, the great wear, as well as inaccuracies in the positioning of the cleaning device at the cylinders, are disadvantageous with this device.

A cleaning arrangement is furthermore known from DE 42 09 642 A1, wherein a cleaning device of the cloth type, known per se, is rotatably arranged around a longitudinal axis extending parallel with the cylinders and is at almost equal distances in respect to it, and which can be selectively allocated to a printing cylinder or a rubber blanket cylinder by being turned. The cleaning cloth is brought into contact with the cylinder to be cleaned by an elastic pressure element being acted upon by compressed air. The drive mechanism for turning the cleaning device is provided in the one wall of the print unit, while the actuating means for advancing the cloth are arranged in the other wall of the print unit.

This cleaning arrangement can only be used for cleaning two cylinders of print units in accordance with the three-cylinder construction.

It is furthermore disadvantageous that the cleaning device interferes with the access to the cylinders because of its arrangement on a central pivot shaft.

OBJECT AND SUMMARY OF THE INVENTION

It is the object of the invention to create a device which permits the cleaning of three cylinders with one cleaning arrangement, which can be produced by simple means and permits access to the cylinders.

In accordance with the invention, this object is attained by means of the characteristics of claim 1.

By means of the attainment of the object in accordance with the invention it is possible to clean several cylinders with one cleaning device, wherein this device can be produced by simple means and permits access to the cylinders without it being necessary to remove the cleaning device.

The invention will be described in greater detail in what follows by means of an exemplary embodiment, represented in the associated drawings.

DETAILED DESCRIPTION OF THE PREFERRED EMBODIMENT

Figure 1:
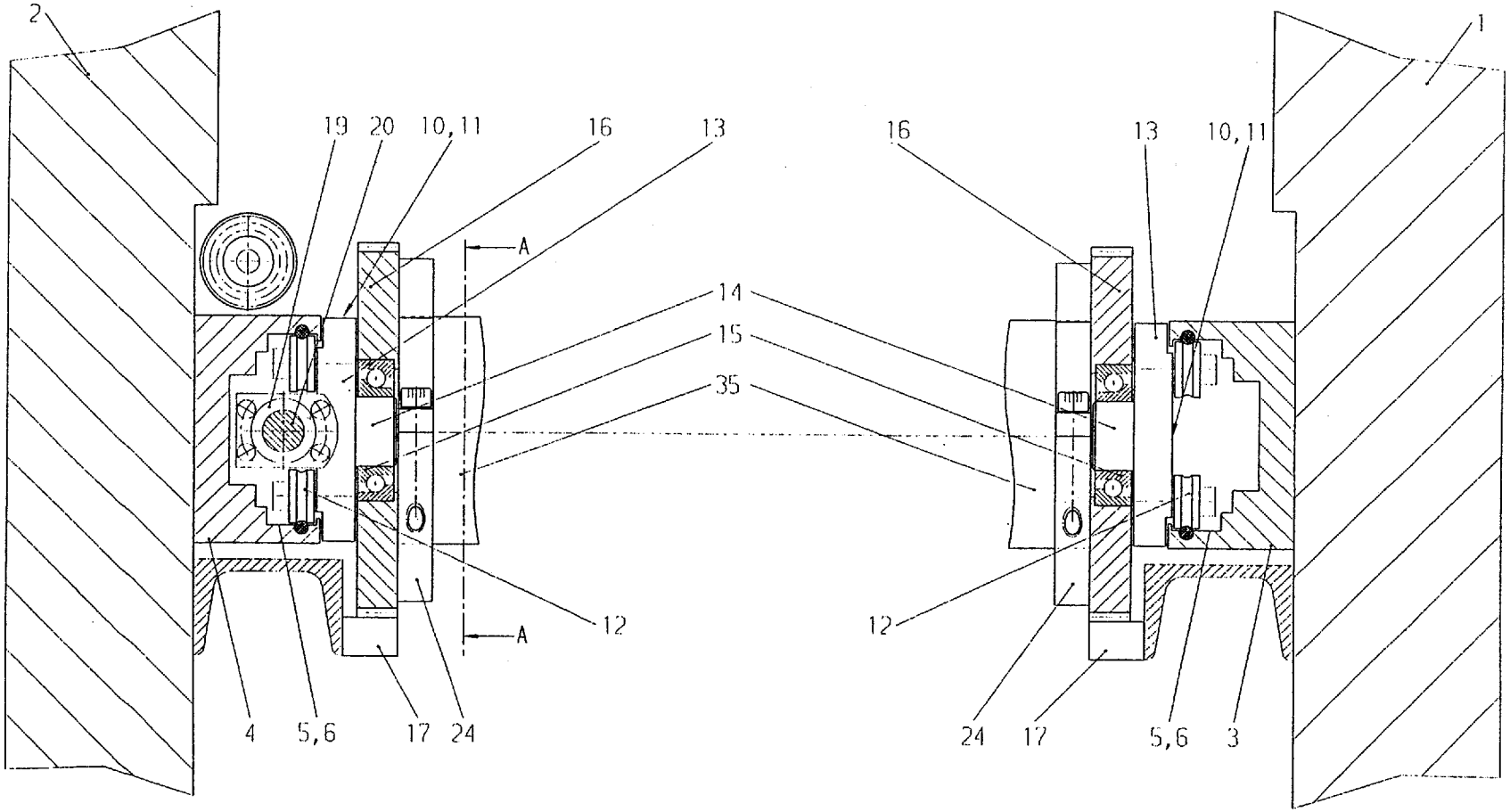
FIG. 1 is a top view on the schematic representation of the device in accordance with the invention.
Figure 2:
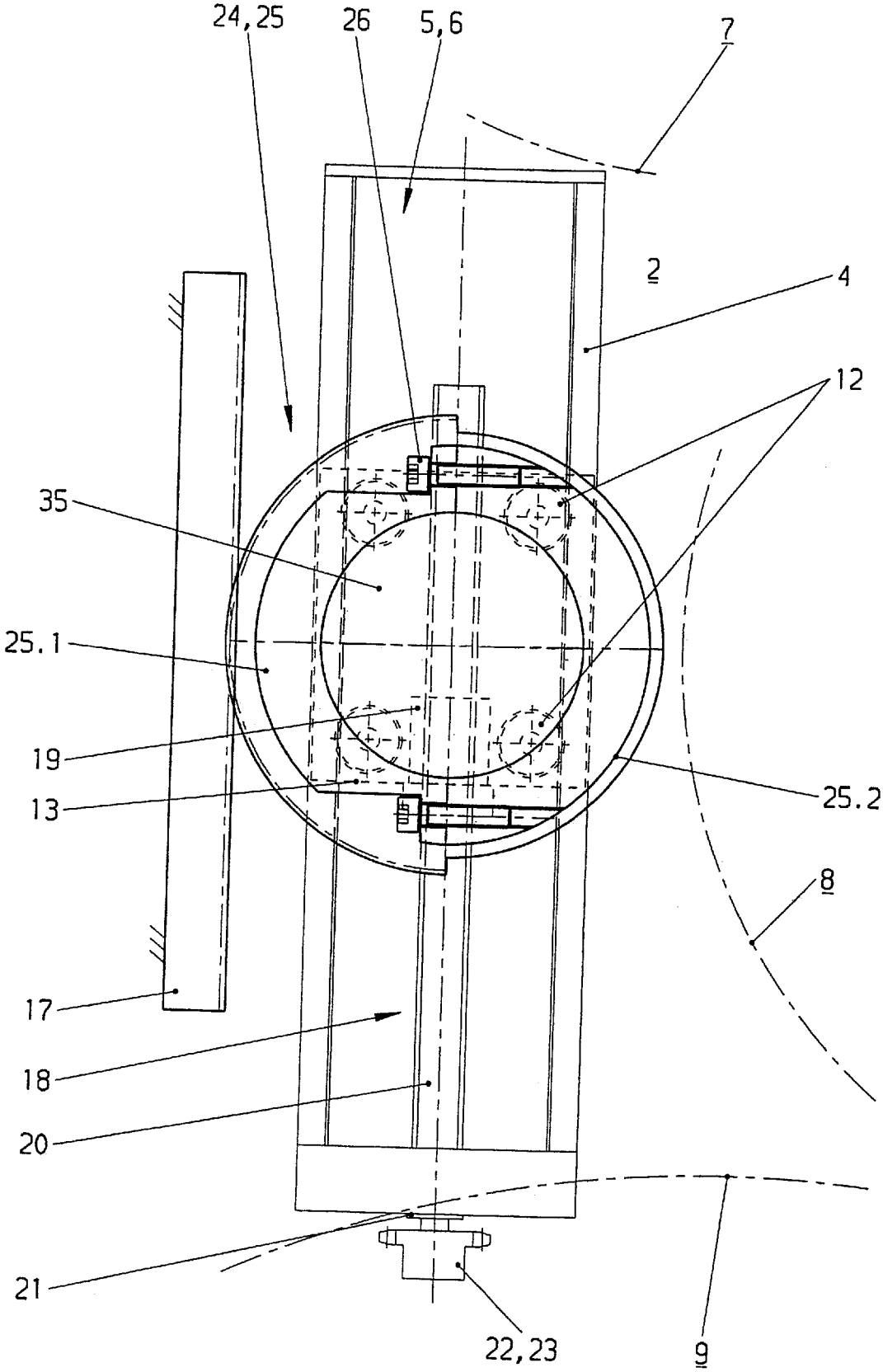
FIG. 2 is a sectional representation in accordance with the line A—A in FIG. 1.

As represented in FIG. 1, guide elements 3 and 4 have been arranged in the print unit walls 1 and 2 and are fixed in the frame. Each one of the guide elements 3 and 4 has a guide track 5 embodied as a straight guide 6. The guide tracks 5 are arranged in the space between a plate cylinder 7, a rubber blanket cylinder 8 and a printing cylinder 9 (FIG. 2). Engagement members 10 are displaceably seated in the guide tracks 5. In the exemplary embodiment, each engagement member 10 is designed as a carriage 11, which engages the guide track 5 with four guide rollers 12, which are arranged on a base plate 13.

The base plate 13 is provided with a bearing journal 14, on which a toothed segment 16 is rotatably seated, for example by means of the roller bearings 15. The toothed segment 16 engages a toothed rack 17, arranged fixed in place on the frame. A displacement device 18 acts on one or both carriages 11, in the exemplary embodiment the carriage 11 arranged in the guide element 4 was used. A nut 19 is arranged, fixed against relative rotation, on the carriage 11 for this purpose, and is engaged by a spindle 20, which is seated in the guide element 4, secured against axial displacement, by means of a bearing 21. A drive element 22 which, for example, is designed as a chain wheel 23, acts on the spindle 20. The carriage 11 can be displaced by turning the chain wheel 23 and therefore the spindle 20.

A coupling member 24 is connected with the toothed segment 16. In the exemplary embodiment, the coupling member 24 is designed as a clamping ring 25, which consists of a fixed element 25.1 and a movable element 25.2. The fixed element 25.1 is arranged, fixed against relative rotation, on the toothed segment 16, while the movable element 25.2 is releasably connected with the fixed element 25.1, for example by means of screws 26.

Figure 3:
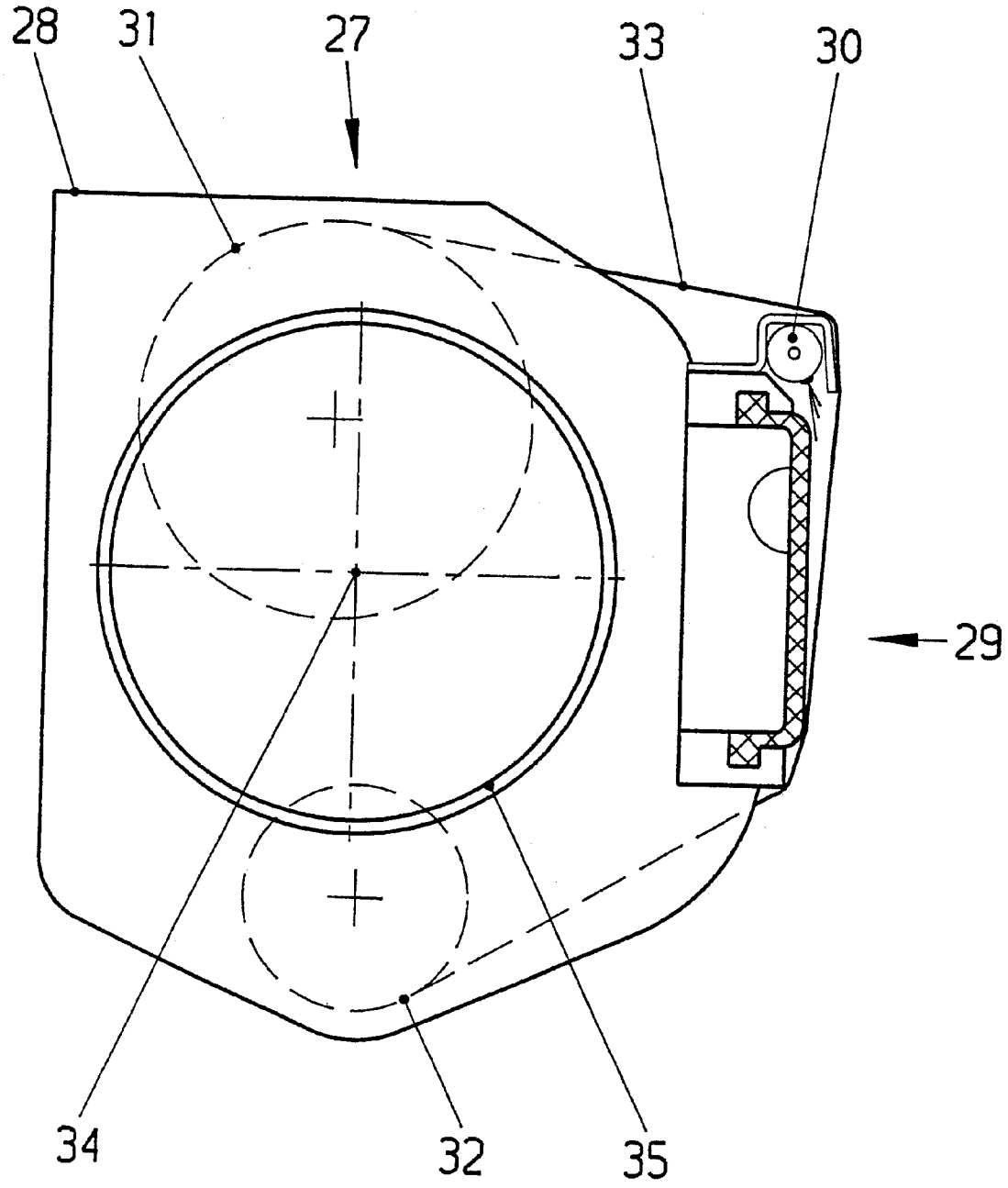
FIG. 3 shows a cleaning device in a lateral view.

A cleaning device 27 of the cloth type, known per se, is represented in FIG. 3. However, cleaning devices of different types can also be employed. The cleaning device 27 is designed as a functional unit and basically consists of two lateral walls 28, between which a pneumatically actuable pressure element 29, which extends over the working width, a spray tube 30, a clean cloth reservoir 31, a dirty cloth reservoir 32 and a cleaning cloth 33 are arranged. The supply devices for the media, as well as the means for transporting the cleaning cloth 33 from the clean cloth reservoir 31 to the dirty cloth reservoir 32, are not represented.

The cleaning device 27 is designed as a functional unit, which is pivotable around an axis of rotation 34. To this end, bearing journals 35 are provided on the lateral walls 28, which are received by the coupling members 24 and are adjusted and fixed in place by means not represented. For this purpose the bearing journals 35 are positioned in the fixed element 25.1 of the clamping rings 25 and thereafter champed in place by means of the movable elements 25.2 and the screws 26.

Figure 4:
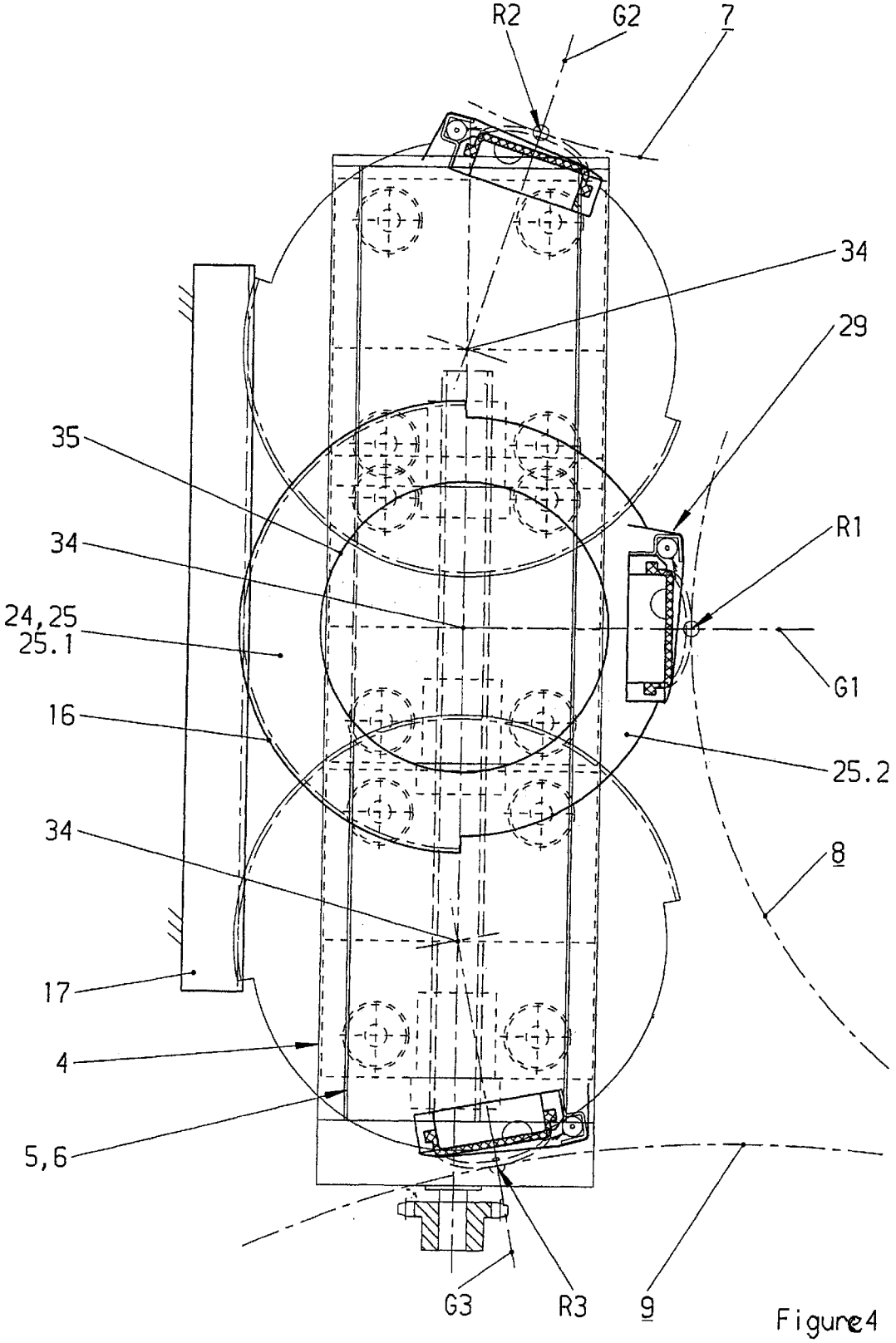
FIG. 4 is a representation in accordance with FIG. 2, showing the working positions of the cleaning device.

The individual positions of the cleaning device 27 are represented in FIG. 4 by the position of the pressure element 29.

In the center position, the cleaning device 27, and therefore the pressure element 29, are allocated to the rubber blanket cylinder 8. If the surface of the rubber blanket cylinder 8 is to be cleaned, the pressure element 29 is charged with compressed air in a known manner. Because of this, the cleaning cloth 33 touches the rubber blanket cylinder 8 along a wiping line R1, which extends parallel with the axis of rotation of the rubber blanket cylinder 8 and parallel with the axis of rotation 34 of the cleaning device 27. A straight line G1, which vertically intersects the wiping line RI and the axis of rotation of the rubber blanket cylinder 8, also intersects the axis of rotation 34 of the cleaning device 27.

The cleaning cloth 33 is moistened by the spray tube 30 with cleaning fluid or water before or while it is being pressed against the surface of the rubber blanket cylinder 8.

The cleaning cloth 33 is pulled off the clean cloth reservoir 31 at intervals, as a function of its degree of being soiled or of the selected cleaning program, and is conducted to the dirty cloth reservoir 32. The drive mechanism, or the respective control devices required for this, are a part of the cleaning device 27 and are not represented.

Regarding the Function:

If it is necessary to clean the plate cylinder 7, the engagement member 10 embodied as a carriage 11 is displaced in the guide track 5 in the direction toward the plate cylinder 7 by means of the displacement device 18, in that the drive element 22, and therefore the spindle 20, are turned. In the process the toothed segment 16, which engages the toothed rack 17 and is rotatably seated on the bearing journal 14 of the carriage 11, is forcibly turned. The coupling member 24, and with it the cleaning device 27, are turned together with the toothed segment 16. The gear ratio between the toothed rack 17 and the toothed segment 16 has been selected such, that the cleaning device 27 is turned within the path which the carriage 11 must travel so that the pressure element 29 approaches the plate cylinder 7, in such a way that a wiping line R2, which extends parallel with the axis of rotation of the plate cylinder 7 and with the axis of rotation 34 of the cleaning device 27, and which is formed when the cleaning cloth rests against the plate cylinder 7, is vertically intersected by a straight line G2, which intersects the axis of rotation 34 and the axis of rotation of the plate cylinder 7 in the same way. Cleaning of the plate cylinder takes place analogously with the cleaning of the rubber blanket cylinder 8.

If the printing cylinder 9 is to be cleaned, the drive element 22, and therefore the spindle 20, are driven in an oppositely directed rotating movement, and therefore the engagement member 10 embodied as the carriage 11 is displaced in the guide track 5 in the direction toward the printing cylinder 9. Because of the forced turning of the toothed segment 16, the cleaning device 27 is conducted into a position in respect to the printing cylinder 9 in which the cleaning cloth 33 guided against the printing cylinder 9 forms a wiping line R3. The wiping line R3 extends parallel with the axis of rotation of the printing cylinder 9 and the axis of rotation 34 of the cleaning device 27, and is vertically intersected by a straight line G3, which intersects the axis of rotation 34 and the axis of rotation of the printing cylinder 9 in the same way. It is of course also possible to couple the spindle 20, which imparts a push movement to the engagement member 10, with a gear 41 arranged on the engagement member 10, which provides the cleaning device 27 with a pivot movement.

Figure 5:
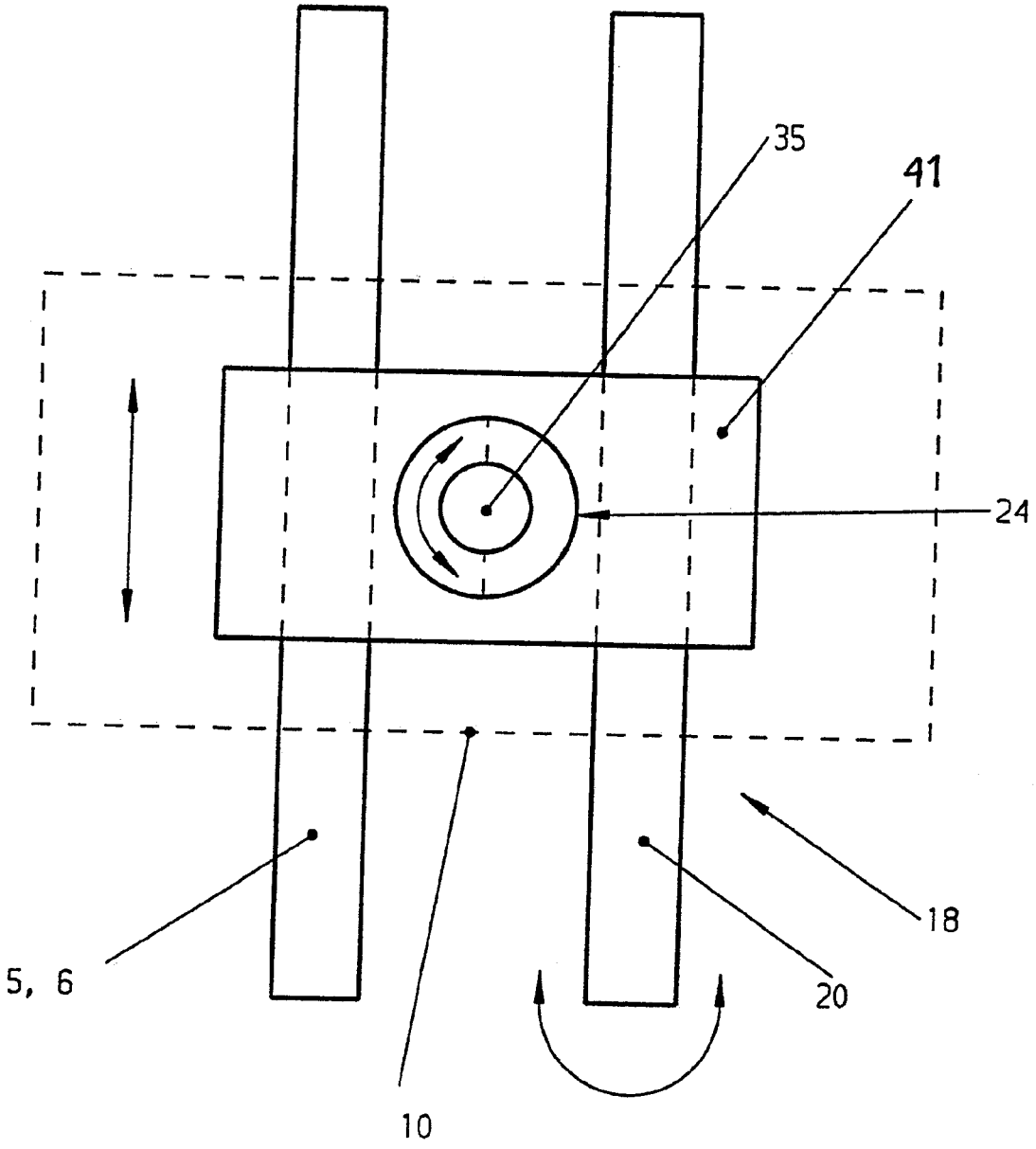
FIG. 5 is a schematic representation of a further embodiment.

The bearing journal 14 is rotatably seated in the engagement member 10 for this purpose and is coupled with the power take-off member of the gear 14. The coupling member 24, which is used for receiving the bearing journal 35 of the cleaning device 27 (FIG. 5), is connected, fixed against relative rotation, with the bearing journal 14.

The parameters of the spindle 20 and the gear 41 are matched to each other in such a way, that the cleaning positions at the plate cylinder 7, the rubber blanket cylinder 8 or the printing cylinder 9 can be selectively assumed.

Figure 6:
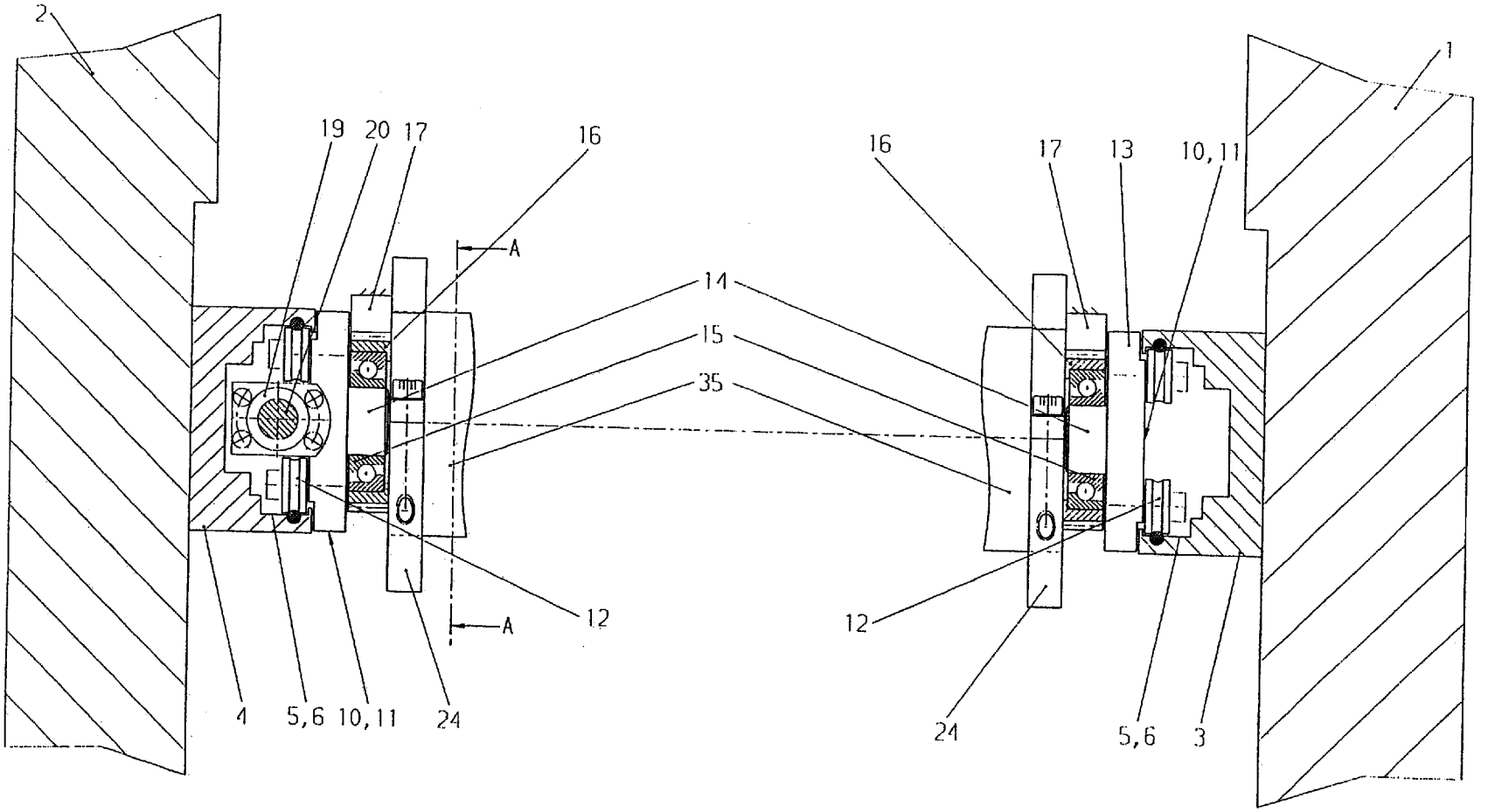
FIG. 6 is a top view on the schematic representation of the device in accordance with the invention in the embodiment with service stations.

A further development of the invention is represented in FIG. 6. It can be seen here that the engagement members 10 are displaceably seated in the guide tracks 5. Each engagement member 10 in FIG. 6 is designed as a carriage 11, which engages the guide track 5 with four guide rollers 12, which are arranged on a base plate 13.

The base plate 13 is provided with a bearing journal 14, on which a gear wheel 16 is rotatably seated, for example by means of the roller bearings 15. The gear wheel 16 engages a toothed rack 17, arranged fixed in place on the frame. A displacement device 18 acts on one or both carriages 11, in the exemplary embodiment the carriage 11 arranged in the guide element 4 was used. A nut 19 is arranged, fixed against relative rotation, on the carriage 11 for this purpose, which is engaged by a spindle 20, which is seated in the guide element 4, secured against axial displacement, by means of a bearing 21. A drive element 22 which, for example, is designed as a chain wheel 23, acts on the spindle 20. The carriage 11 can be displaced by turning the chain wheel 23 and therefore the spindle 20.

A coupling member 24 is connected with the gear wheel 16. In the exemplary embodiment, the coupling member 24 is designed as a clamping ring 25, which consists of a fixed element 25.1 and a movable element 25.2. The fixed element 25.1 is arranged, fixed against relative rotation, on the gear wheel 16, while the movable element 25.2 is releasably connected with the fixed element 25.1, for example by means of screws 26.

Figure 7:
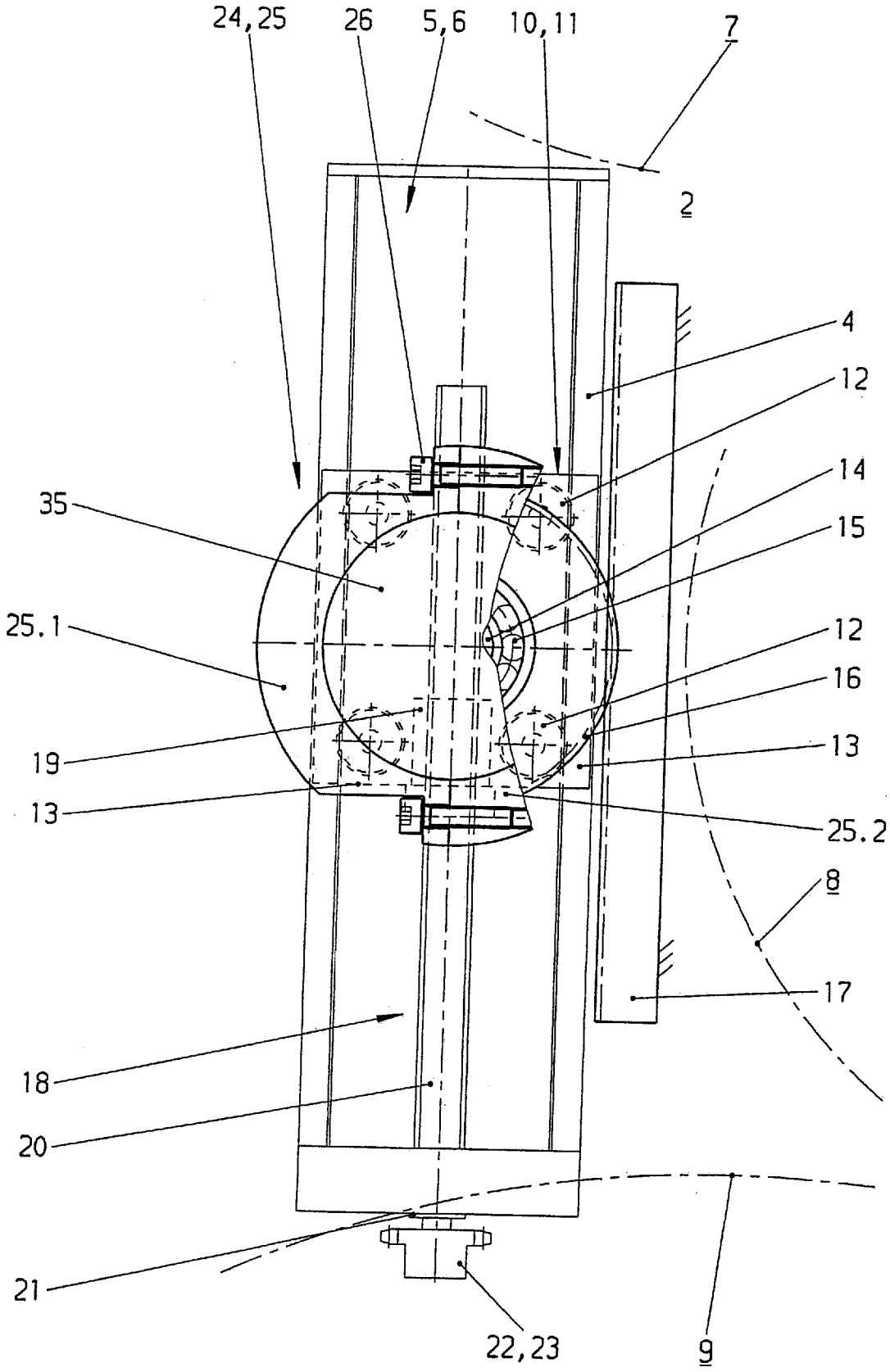
FIG. 7 is a sectional representation in accordance with the line A—A in FIG. 6.
Figure 8:
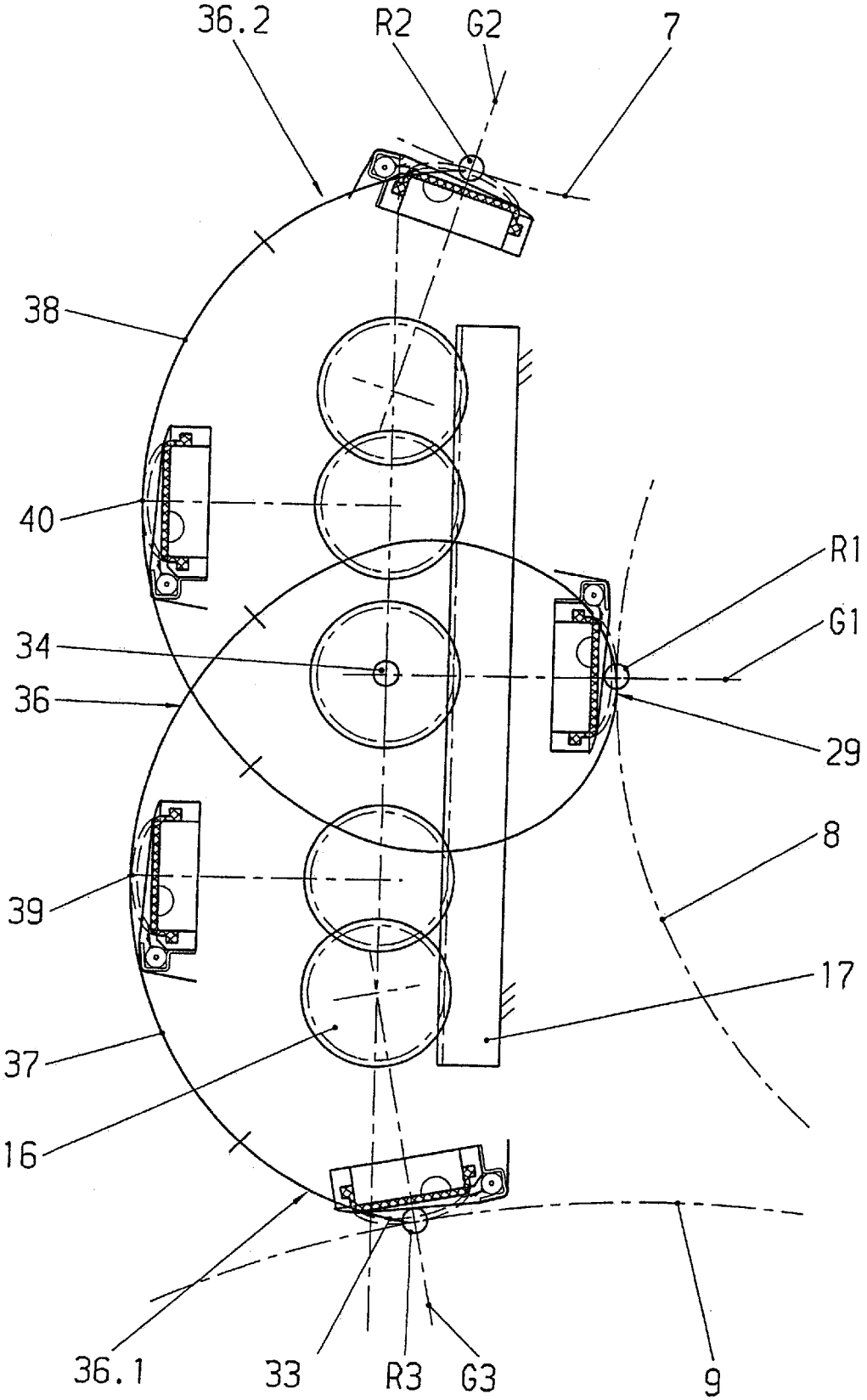
FIG. 8 is a representation in accordance with FIG. 6, showing the work and service positions of the cleaning device.

Working positions to be assumed by the cleaning device 27 at the plate cylinder 7, the rubber blanket cylinder 8 and the printing cylinder 9, as well as service positions, are represented in FIG. 7 by means of the position of the pressure element 29, as well as the gear wheel 16.

In the working position at the rubber blanket cylinder 8, and when the pressure element 29 is charged with compressed air in the known manner, the cleaning cloth 33 is in contact with the cylinder along a wiping line R1, which extends parallel with the axis of rotation of the rubber blanket cylinder 8 and parallel with the axis of rotation 34 of the cleaning device 27, wherein the axis of rotation 34 and the axis of rotation of the gear wheel 16 coincide. A straight line G1, which vertically intersects the wiping line R1 and the axis of rotation of the rubber blanket cylinder 8, intersects the axis of rotation 34 of the cleaning device 27 in the same way.

Analogously with this, the cleaning cloth 33 in its working position at the plate cylinder 7 touches the latter along a wiping line R2, which extends parallel with the axis of rotation of the plate cylinder 7 and parallel with the axis of rotation 34. The wiping line R2, the axis of rotation of the plate cylinder 7 and the axis of rotation 34 are vertically intersected by a straight line G2.

In the working position at the printing cylinder 9, the cleaning cloth 33 touches along a wiping line R3. The wiping line R3 extends parallel with the axis of rotation of the printing cylinder 9 the axis of rotation 34. The wiping line R3, the axis of rotation of the printing cylinder 9 and the axis of rotation 34 are vertically intersected by a straight line G3.

The mode of operation of the device is as follows:

As represented in FIG. 4, for cleaning the printing cylinder 9 the pressure element 29 is charged with compressed air in the working position at the printing cylinder 9, and the cleaning cloth 33 is thereby brought into contact with the surface of the printing cylinder 9 and the cleaning cloth 33 is moistened.

If the rubber blanket cylinder 8 is to be cleaned, the engagement member 10 embodied as a carriage 11 is displaced in the direction toward the plate cylinder 7 by means of the displacement device 18, in that the drive element 22, and therefore the spindle 20, are turned. In the process the gear wheel 16 rolls off on the toothed rack 17 without sliding, wherein the cleaning device 27 is turned via the coupling member 24, so that the pressure element 33 follows a track curve which is embodied as an extended cycloid 36. The extended cycloid 36 consists of a first curve element 36.1 and a second curve element 36.2. When the pressure element 29 has reached the working position at the rubber blanket cylinder 8, the displacement of the carriage 11 is interrupted and the cleaning cloth 33 is brought into contact with the surface of the rubber blanket cylinder 8 by means of the pressure element 29 and the surface is cleaned in the known manner.

If it is required to clean the plate cylinder 7, the carriage 11 is further displaced in the direction of the plate cylinder 7 and in the process the pressure element 29, which runs through the second curve element 36.2 of the extended cycloid 36, is brought into the working position at the plate cylinder 7, and the plate cylinder 7 is cleaned. The course of the extended cycloid 36 is determined by the position of the working position at the plate cylinder 7, the rubber blanket cylinder 8 and the printing cylinder 9.

The pressure element 29 passes through the first curve element 36.1 when moving the cleaning device 27 from the printing cylinder 9 to the rubber blanket cylinder 8, or from the rubber blanket cylinder 8 to the printing cylinder 9, while the pressure element 29 passes through the second curve element 36.2 when moving the cleaning device 27 to the plate cylinder 7, or from the latter to the rubber blanket cylinder 8. In the course of passing through the curve elements 36.1, 36.2, the pressure element 29 is guided along a first service area 37 and a second service area 38, wherein it is in a position facing away from the plate cylinder 7, rubber blanket cylinder 8 and printing cylinder 9. The pressure element 29, and therefore the cleaning device 27, are accessible in this first and second service area 37, 38, so that service operations are possible without having to remove the entire cleaning device 27. For example, the exchange of the clean cloth reservoir 31 and/or of the dirty cloth reservoir 32 can be performed without problems.

In the exemplary embodiment, a first service position 39 and a second service position 40 are provided, in which access to the pressure element 29, and therefore the cleaning device 27, is possible. It is basically possible to provide any arbitrary service position within the first service area 37 and the second service area 38 for maintenance of the cleaning device 27.

What is claimed is:

1. A device for the selective cleaning of each one of a plurality of cylinders in a print unit of printing press comprising:

a cylinder cleaning device including a cleaning element selectively engageable with a surface of each of a plurality of cylinders to be cleaned, said cylinder cleaning device having an axis of rotation;

a straight guide track supported adjacent the plurality of cylinders to be cleaned;

means for supporting said cylinder cleaning device in said straight guide track for rotation about said cylinder cleaning device axis of rotation, said means for supporting said cylinder cleaning device including a carriage;

means for displacing said cylinder cleaning device along said straight guide track between the plurality of cylinders to be cleaned, said means for displacing said cylinder cleaning device including a displacement device, said displacement device, including a rotatable spindle and further including a nut on said carriage, said nut receiving said rotatable spindle; and means for rotating said cylinder cleaning device about said cylinder cleaning device axis of rotation during said displacement of said cylinder cleaning device along said straight guide track between a plurality of cylinder cleaning positions and at least one service area.

2. The device of claim 1 further including a coupling member secured to said carriage, said coupling member receiving said cylinder cleaning device.

3. The device of claim 2 wherein said coupling member is rotated during said displacement of said carriage in said straight guide track.

4. The device of claim 1 wherein the plurality of cylinders include a plate cylinder, a rubber blanket cylinder and a printing cylinder and further wherein said cleaning element of said cylinder cleaning device is selectively engageable with each of some plate cylinder, rubber blanket cylinder and printing cylinder during said displacement of said cylinder cleaning device along said straight guide track.

5. The device of claim 1 wherein said carriage includes a base plate and a plurality of guide rollers attached to said base plate, said guide rollers being supported by said straight guide track.

6. The device of claim 5 further including a bearing journal on said base plate, a toothed segment supported by said bearing journal, and a coupling member secured to said toothed segment and receiving said cylinder cleaning device.

7. A device for the selective cleaning of each one of a plurality of cylinders in a print unit of a printing press comprising:

a cylinder cleaning device including a cleaning element selectively engageable with a surface of each of a plurality of cylinders to be cleaned, said cylinder cleaning device having an axis of rotation;

a straight guide track supported adjacent the plurality of cylinders to be cleaned;

means for supporting said cylinder cleaning device in said straight guide track for rotation about said cylinder cleaning device axis of rotation;

means for displacing said cylinder cleaning device along said straight guide track between the plurality of cylinders to be cleaned; and means for rotating said cylinder cleaning device about said cylinder cleaning device axis of rotation during said displacement of said cylinder cleaning device along said straight guide track and for moving said cleaning element along a curved path having the shape of an extended cycloid.

8. The device of claim 7 wherein said curved path includes a plurality of cylinder cleaning positions and at least one cylinder cleaning device service area.

9. A device for the selective cleaning of each one of a plurality of cylinders in a print unit of a printing press comprising:

a cylinder cleaning device including a cleaning element selectively engageable with a surface of each of a plurality of cylinders to be cleaned, said cylinder cleaning device having an axis of rotation;

a straight guide track supported adjacent the plurality of cylinders to be cleaned;

means for supporting said cylinder cleaning device in said straight guide track for rotation about said cylinder cleaning device axis of rotation, said means for supporting said cylinder cleaning device including a carriage;

means for displacing said cylinder cleaning device along said straight guide track between the plurality of cylinders to be cleaned, said means for displacing said cylinder cleaning device including a displacement device;

means for rotating said cylinder cleaning device about said cylinder cleaning device axis of rotation during said displacement of said cylinder cleaning device along said straight guide track between a plurality of cylinder cleaning positions and at least one service area;

a coupling member secured to said carriage, said coupling member receiving said cylinder cleaning device; and a toothed segment joined to said coupling member and a toothed rack on the print unit, said toothed segment engaging said toothed rack.

10. A device for the selective cleaning of each one of a plurality of cylinders in a print unit of a printing press comprising:

a cylinder cleaning device including a cleaning element selectively engageable with a surface of each of a plurality of cylinders to be cleaned; and cylinder cleaning device having an axis of rotation;

a straight guide track supported adjacent the plurality of cylinders to be cleaned;

means for supporting said cylinder cleaning device in said straight guide track for rotation about said cylinder cleaning device axis of rotation;

means for displacing said cylinder cleaning device along said straight guide track between the plurality of cylinders to be cleaned, said cleaning element of said cylinder cleaning device following a curved path formed as an extended cycloid during said displacement of said cylinder cleaning device along said straight guide path; and means for rotating said cylinder cleaning device about said cylinder cleaning device axis of rotation during said displacement of said cylinder cleaning device along said straight guide track between a plurality of cylinder cleaning positions and at least one service area.

11. The device of claim 10 wherein said cylinder cleaning device is brought into a service position in said at least one service area.

* * * * *